United States Patent [19]

Olschansky et al.

[11] Patent Number: 4,666,149

[45] Date of Patent: May 19, 1987

[54] MULTI-EXERCISE SYSTEM

[75] Inventors: Brad Olschansky; Scott Olschansky, both of Sparks, Md.

[73] Assignee: Lifeing, Inc., Baltimore, Md.

[21] Appl. No.: 765,693

[22] Filed: Aug. 15, 1985

Related U.S. Application Data

[63] Continuation-in-part of Ser. No. 597,731, Apr. 11, 1984, Pat. No. 4,600,189.

[51] Int. Cl.[4] ..... A63B 21/00

[52] U.S. Cl. ..... 272/116; 272/134; 272/142; 272/DIG. 4

[58] Field of Search ..... 272/117, 118, 134–142, 272/DIG. 4, 72, 116, 123, 130, 131, 132

[56] References Cited

U.S. PATENT DOCUMENTS

| | | | |
|---|---|---|---|
| 2,777,439 | 1/1957 | Tuttle | 272/132 X |
| 2,855,199 | 10/1958 | Noland et al. | 272/134 X |
| 3,721,438 | 3/1973 | Kusmer | 272/132 X |
| 4,208,049 | 6/1980 | Wilson | 272/141 X |
| 4,226,415 | 10/1980 | Wright | 272/DIG. 4 X |
| 4,328,964 | 5/1982 | Walls | 272/136 |
| 4,492,375 | 1/1985 | Connelly | 272/142 X |
| 4,500,089 | 2/1985 | Jones | 272/118 X |
| 4,546,971 | 10/1985 | Raasoch | 272/134 X |
| 4,568,078 | 2/1986 | Weiss | 272/134 X |

FOREIGN PATENT DOCUMENTS

| | | | |
|---|---|---|---|
| 8005681 | 5/1982 | Netherlands | 272/134 |

*Primary Examiner*—Richard J. Apley
*Assistant Examiner*—Robert W. Bahr
*Attorney, Agent, or Firm*—Morton J. Rosenberg

[57] ABSTRACT

A multi-exercise system (10) is provided to actuate a resistive force loading responsive to an applied force by a user. The system (10) includes a base frame (24) mounted on a base surface (22). The base frame (24) includes a pair of base bar frame members (36 and 38) which are extended in the vertical direction (18) and are displaced each from the other in a horizontal direction (20). A resistive force mechanism (40) is vertically displaceable on the base bar frame members (36 and 38) and are further fixedly securable at predetermined vertical locations at the discretion of the user. A rotational actuation mechanism (84) is rotatable about a singular axis (16) and is coupled to an upper portion (42) of the resistive force mechanism (40). The rotational actuation mechanism (84) linearly displaces a resistive force mechanism first lower portion (46) with respect to a resistive force mechanism second lower portion (48) responsive to a rotational actuation force applied by the user. The resistive force mechanism second lower portion (48) is rigidly secured to the resistive force mechanism upper portion (42) and is linearly displaceable with respect to the resistive force mechanism first lower portion (46). The multi-exercise system (10) allows for rotational actuation about the singular axis (16) and provides for a simplified operating mechanism for resistive force loading.

20 Claims, 8 Drawing Figures

MULTI-EXERCISE SYSTEM

REFERENCE TO RELATED APPLICATIONS

This Patent Application is a continuation-in-part of U.S. patent application Ser. No. 597 731, filed on Apr. 11, 1984 and entitled Multi-Function Exercise System, this patent application now U.S. Pat. No. 4,600,189.

BACKGROUND OF THE INVENTION

1, Field of the Invention

This invention is directed to a multi-exercise system. Particularly, this invention is directed to a multi-exercise system wherein a user may exercise different portions of his or her body and allows adjustability of the system to differing physical characteristics of the user. Still further, this invention is directed to a multi-exercise system which includes a rotatively actuated bar mechanism utilized in combination with a rotational actuation mechanism rotatable about a singular axis. Additionally, this invention is directed to a multi-exercise system which includes a resistive force mechanism adjustable and fixedly securable to a pair of vertically directed bar frame members. Further, this invention relates to a multi-exercise system where the rotational actuation mechanism is coupled to a resistive force mechanism composed of an upper portion having a singular pulley for translating user rotational actuation to a linear displacement. More in particular, this invention pertains to the multi-exercise system where the resistive force mechanism includes an upper portion as well as a first and second lower portion wherein the second lower portion is fixedly secured to the upper portion of the resistive force mechanism and the first lower portion is displaceable with respect to the resistive force second lower portion responsive to a rotative actuation by the user.

2. Prior Art

Exercise systems using rotational actuation mechanisms for linearly displacing a resistive force loading are known in the art. However, in some such prior art systems, the rotational actuation mechanisms are not adjustable in an angular orientation to accomodate differing portions of a user's body when applying a rotative displacement of the force thereon. In other prior art systems, complicated pulley mechanisms are used to provide the conversion between rotationally applied forces to a linear displacement of resistive force loading. In such prior art systems, the concatenation of working mechanisms are generally complicated and provide for increased hardware costs.

In other prior art systems, the rotational actuation of the user applied force is adjustable through the use of placing weight elements on or off of the displacing mechanism. Such prior art systems do not allow for the user to adjust the resistive force by mere insertion of a pin member into one or more of a plurality of resistive force load coupling mechanisms.

Other prior art exercising systems do not provide for an adjustable seat mechanism for permitting the user to apply the resistance forces when in a sitting position. Still other prior art systems do not provide for movable seat mechanisms to provide differing orientations for a user applying the force loading.

SUMMARY OF THE INVENTION

A multi-exercise system for providing a resistive force loading responsive to an applied force by a user.

The multi-exercise system includes a base frame having at least a pair of substantially vertically elongated and horizontally displaced base bar frame members. A resistive force mechanism is fixedly securable to at least one of the base bar frame members for transferring the user applied force to the resistive force loading. A rotational actuation mechanism is coupled to an upper portion of the resistive force mechanism for linearly displacing a first lower portion of the resistive force mechanism with respect to a second lower portion of the resistive force mechanism responsive to a rotational actuation force applied by the user.

DESCRIPTION OF THE PREFERRED EMBODIMENTS

Figure 1:
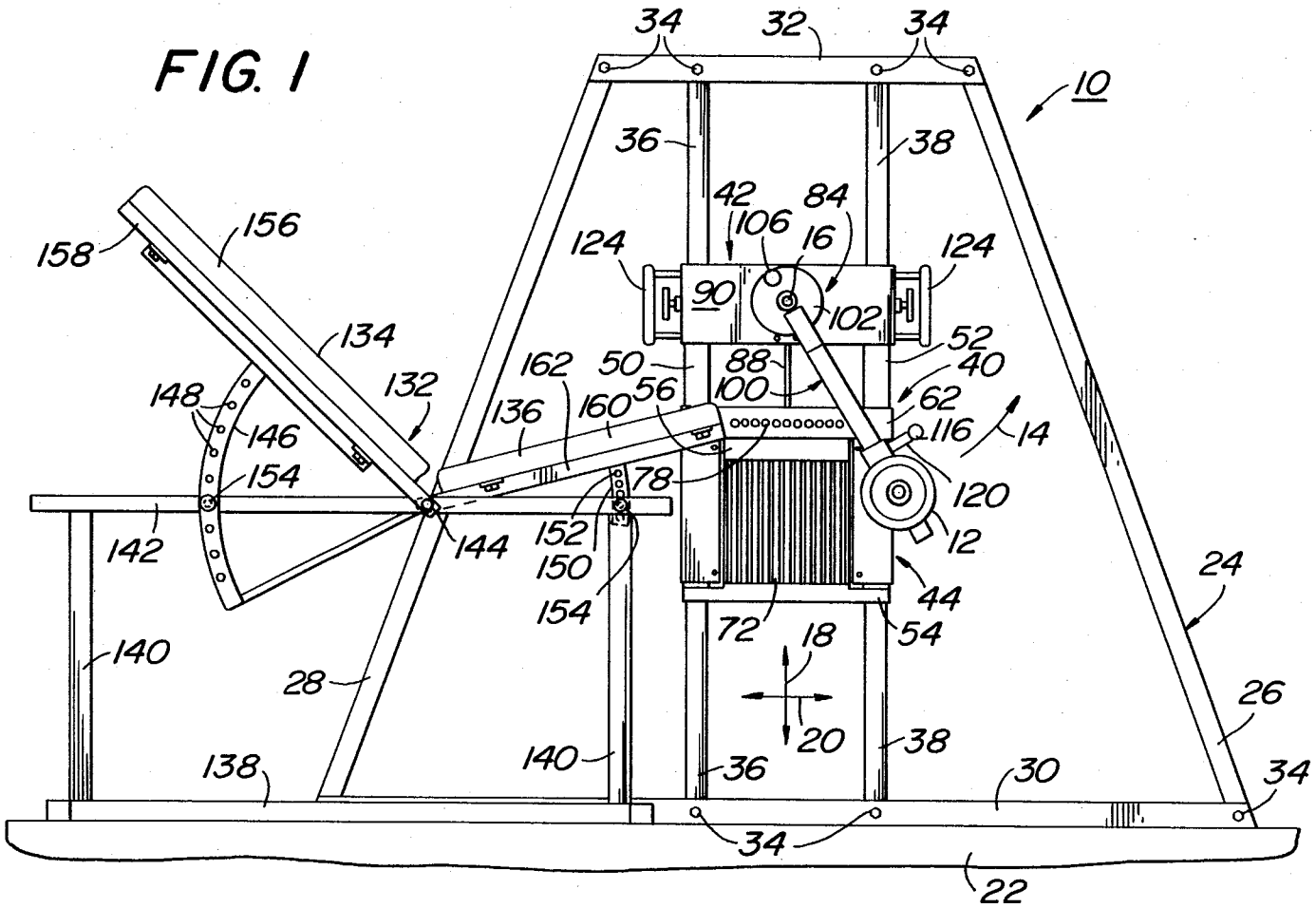
FIG. 1 is a frontal view of the multi-exercise system.
Figure 2:
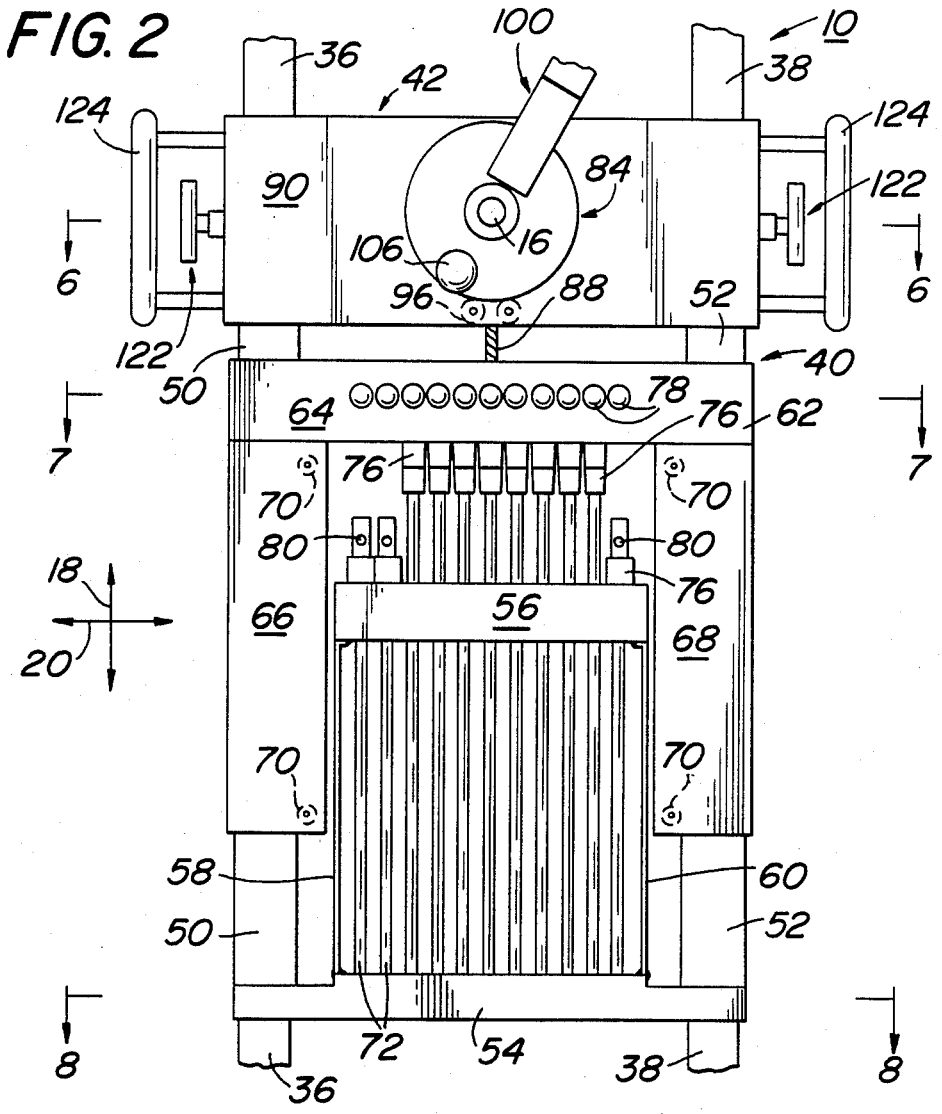
FIG. 2 is a frontal view partially in cut-away of the multi-exercise system showing the resistive force mechanism.

Referring now to FIGS. 1 and 2, there is shown multi-exercise system 10 for providing a resistive force loading responsive to an applied force by a user. In overall concept, multi-exercise system 10 allows the user to apply a rotational displacement to pad member 12 shown in FIGS. 1 and 6, in the direction of arcuate directional arrow 14. Through this displacement, as will be seen in following paragraphs, the rotational displacement of pad member 12 in direction 14 results in a rotational to linear displacement transfer which acts on a resistive force within the system to provide exercise for the user.

Further, system 10 is directed in general concept to an exercising mechanism which provides for a wide variety of exercises for the user and further allows adjustability in the mechanisms to increase the number of exercises and the applicability to a wide range of user physical characteristics. Still further, multi-exercise system 10 allows for a simplified mechanism where the rotary displacement applied by the user is transferred to a linear displacement mechanism through rotation about singular axis 16. Utilization of singular axis 16 provides for a simplified mechanism for multi-exercise system 10 than is known for prior art systems.

Multi-exercise system 10 includes base frame 24 for interfacing with base surface 22 in order to provide system 10 with a stable platform upon which the working mechanisms may be actuated. Base frame 24 may include system floor structural members 30 which extend in horizontal or transverse direction 20 and contiguously interface with base surface 22. Opposing inclined system structural members 26 and 28 extend in an inclined and vertical direction 18 for coupling with system upper structural members 32 which pass in horizontal direction 20. Structural members 26, 28, 30 and 32 are coupled each to the other through structural bolts 34 or some like mechanism, such as welding, however, such is not important to the inventive concept as herein described, with the exception that the associated structural members be coupled each to the other in a substantially rigid manner and acceptable for the structural loads imposed thereon.

System structural members 26, 28, 30 and 32 may be formed of steel channels, tubing, angle-irons, or some like configuration not important to the inventive concept as herein described. Additionally, the afore-mentioned structural members 26–32 may be formed of aluminum or some like metal or other material where the only restriction is that such provide sufficient structural integrity to accept the loads applied by system 10 as well as the applied forces by the user.

Referring now to FIGS. 1, 2, 4, and 6–8, there are shown base bar frame members 36 and 38 extending in vertical direction 18 and displaced each from the other in horizontal direction 20. Base bar frame members 36 and 38 are important to the inventive concept as herein described, since such provide for a displacement frame section upon which operating mechanisms are displaceably actuated as will be described in following paragraphs. Base bar frame members 36 and 38 as seen in FIG. 1 are secured to system floor structural member 30 and system upper structural member 32 through bolts 34. Frame members 36 and 38 may be formed of metallic tubing or some like configuration, and formed of steel, aluminum, or some like metallic composition, not important to the inventive concept as herein described, with the exception that such provide for structural integrity responsive to the loads imposed thereon.

Figure 4:
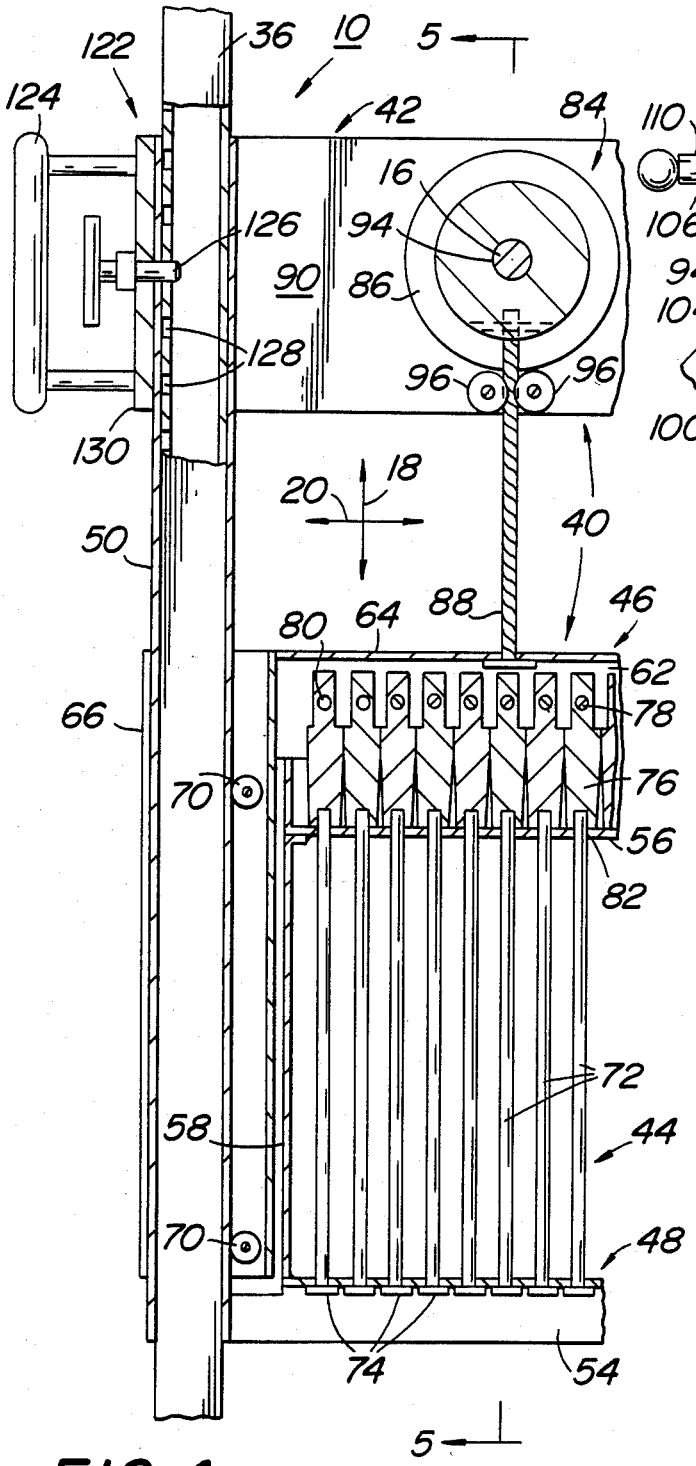
FIG. 4 is a frontal view, partially in cut-away of the rotational actuation mechanism in combination with the resistive force mechanism of the multi-exercise system.

Referring now to FIGS. 1, 2 and particularly to FIG. 4, there is shown resistive force mechanism 40 which is adapted to be fixedly secured to base bar frame members 36 and 38 as well as displaceable with respect thereto and is used for transferring user applied force to the resistive force loading. Resistive force mechanism 40 includes resistive force mechanism upper portion 42 and resistive force mechanism lower portion 44. Resistive force mechanism lower portion 44 includes resistive force mechanism first lower portion 46 and resistive force mechanism second lower portion 48, as is shown in FIG. 4. Resistive force mechanism second lower portion 48 is fixedly secured to resistive force mechanism upper portion 42 and are secured each to the other by resistive force tubular members 50 and 52 which pass around and are slidably displaceable with respect to base bar frame members 36 and 38. Thus, resistive force mechanism upper portion 42 may be welded or otherwise coupled to resistive force tubular member 50, as is shown in FIG. 4. Tubular member 50 (as well as tubular member 52) passes in vertical direction 18 to resistive force mechanism second lower portion 48 where such is welded or otherwise coupled to second lower portion bar member 54 forming part of resistive force mechanism second lower portion 48. Second lower portion bar member 54 extends in transverse or horizontal direction 20 and is fixedly secured on opposing ends thereof to resistive force tubular members 50 and 52.

In this manner, it is seen that a vertical displacement in direction 18 of resistive force mechanism upper portion 42 is transmitted through resistive force tubular members 50 and 52 and correspondingly and responsively, displaces resistive force mechanism second lower portion 48 and in particular, second lower portion bar member 54. It is further important to note that upper portion 42 and resistive force mechanism second lower portion 48 slidingly or otherwise displacingly pass over base bar frame members 36 and 38. Although referred to as a bar member, it is clearly seen that second lower portion bar member 54 may be formed in a channel-like configuration, as is clearly seen in FIG. 5. Thus, upper and second lower portions of resistive force means 42 and 48 are vertically displaceable with respect to base bar frame members 36 and 38, as a unit.

Resistive force mechanism second lower portion 48 includes second lower portion housing member 56 which is vertically secured to and vertically displaced from second lower portion bar member 54. Second lower portion housing member 56 is rigidly and fixedly secured to second lower portion bar member 54 by connecting structural members 58 and 60 which extend in vertical direction 18 and are welded or otherwise fixedly secured on opposing ends thereof to second lower portion housing member 56 and second lower portion bar member 54. The coupling and configuration for members 56 and 54 is clearly seen in FIG. 2. In this manner, it is seen that vertical displacement of resistive force mechanism upper portion 42 results in a corresponding and responsive vertical displacement of second lower portion bar member 54 as well as the identical displacement of second lower portion housing member 56, since all of these component elements are rigidly coupled each to the other.

Resistive force mechanism 40 further includes first lower portion housing member 62 which is displaceably coupled to second lower portion bar member 54 as well as it is displaceably coupled to upper portion 42.

Figure 5:
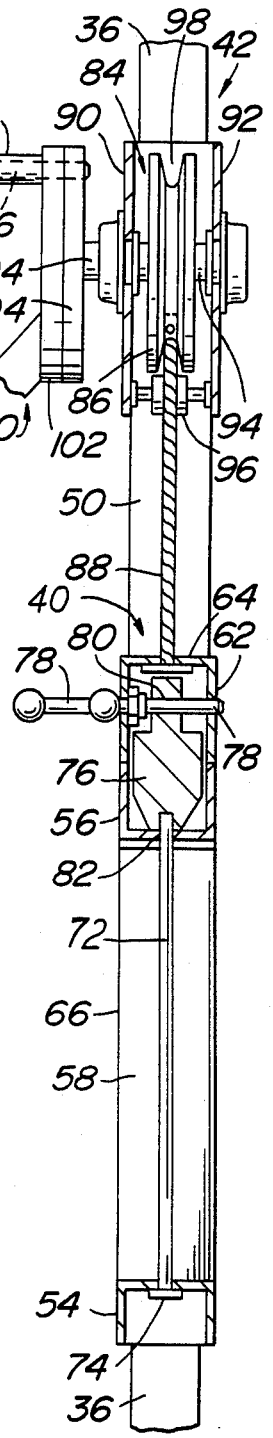
FIG. 5 is a sectional view partially in cut-away of the multi-exercise system taken along the section lines 5—5 of FIG. 4.

First lower portion housing member 62 is clearly seen in FIGS. 2, 4 and 5. First lower portion housing member 62 may be generally U-shaped in contour, as is seen in FIG. 2, and formed of horizontally directed channel member 64 rigidly secured on opposing horizontal ends to vertically directed housing channel members 66 and 68. As is seen in FIGS. 2 and 4, vertically directed housing channel members 66 and 68 pass around resistive force tubular members 50 and 52 and are displaceable with respect thereto through roller members 70. In this manner, first lower portion housing member 62 may be displaceably actuated with respect to second lower portion housing member 56 from a contiguous position shown in FIGS. 4 and 5 to a displaced position as is shown in FIG. 2.

In this manner, it is seen that when first lower portion housing member 62 is in contiguous contact with second lower portion housing member 56 and second lower portion bar member 54, vertical movement or displacement of resistive force mechanism upper portion 42 causes a responsive reversible vertical displacement of second lower portion bar member 54, second lower portion housing member 56, as well as first lower portion housing member 62 on base bar frame members 36 and 38. As will be described in following paragraphs when an applied force is provided by a user, and upper resistive force mechanism portion 42 as well as resistive force mechanism lower portion 44 are fixedly secured to base bar frame members 36 and 38, first lower portion housing member 62 is vertically displaceable with respect to second lower portion bar member 54 in a resistive force loading application.

Second lower portion bar member 54 is displaceably coupled to first lower portion housing member 62. In particular, second lower portion bar member 54 is elastically coupled to first lower portion housing member 62 through a multiplicity of elastic cord members 72 secured on opposing ends thereof to first lower portion housing member 62 and to second lower portion bar member 54. Elastic cord members 72 may be coupled to second lower portion bar member 54 by securement of elastic cord block members 74 as is clearly seen in FIG. 4. Block members 74 may be individual blocks having a dimension greater than an opening formed in bar member 54, or in the alternative, may be a knotted end having a dimension greater than an opening provided in bar member 54. The particular manner and mode of securement is not important to the inventive concept as herein described, with the exception that cord members 72 be coupled to second lower portion bar member 54.

The utilization of a plurality of elastic cord members 72 allows for varying a resistive force loading between first lower portion housing member 62 and second lower portion bar member 54. Thus, the plurality of elastic cord members 72 are secured on one end to second lower portion bar member 54 and are releasably secured on an opposing end to first lower portion housing member 62. The releasable securement mechanism is provided by fixedly securing elastic cord members 74 to block members 76 shown in FIGS. 2, 4 and 5, which rest on the floor of second lower portion housing member 56 and are releasably securable to first lower portion housing member 62.

Block pin members 78 are manually insertable through openings 80 formed in cord block members 76 and through corresponding and aligned openings formed in a back wall of first lower portion housing member 62 as is clearly seen in FIG. 5. In this manner, block members 76 may be fixedly secured to displaceable first lower portion housing member 62. Elastic cord members 72 are freely displaceable in vertical direction 18 through openings 82 formed in second lower portion housing member 56. Thus, as can clearly be seen by one skilled in the art, insertion of varying numbers of block pin members 78 into securement with first lower portion housing member 62 allows for a varying force loading to be applied for displacement of first portion housing member 62 at the discretion of the user.

Referring now to FIGS. 1, 2, 4 and 5, there is shown rotational actuation mechanism 84 which is rotationally coupled to resistive force mechanism upper portion 42 for linearly displacing first lower portion housing member 62 in vertical direction 18 with respect to second lower portion 48 of resistive force mechanism 40 responsive to a rotational actuation force applied by the user. Rotational actuation mechanism 84 is rotatable about singular axis 16 and is rotationally coupled to front and back structural members 90 and 92 of upper portion 42 through rotatable shaft members 94.

Pulley member 86 is coupled to pulley cord member 88 which is secured on opposing ends thereof to first lower portion housing member 62 and to pulley member 86, as is clearly shown in FIG. 4. The particular coupling mechanism of pulley cord member 88 is not important to the inventive concept as herein described, with the exception that such be fixedly secured on opposing ends to each of the members 62 and 86. Pulley cord member 88 is vertically aligned by pulley rollers 96 through which pulley cord member 88 passes. Additionally, pulley member 86 includes channel 98 within which pulley cord 88 passes and is rolled upon pulley member 86.

Rotational actuation mechanism 84 further includes user actuated bar member 100 which is rotationally actuatable by the user to cause a responsive rotation of rotatable shaft member 94 fixedly coupled to pulley member 86. In this manner, rotation of user actuated bar member 100 causes a responsive rotation of pulley member 86 which rolls pulley cord member 88 onto pulley member 86 and causes a responsive vertical displacement of first lower portion housing member 62. The amount of force necessary to displace first lower portion housing member 62 is a function of the number of elastic cords 72 which are coupled to first lower portion housing member 62, as has previously been described.

Figure 3:
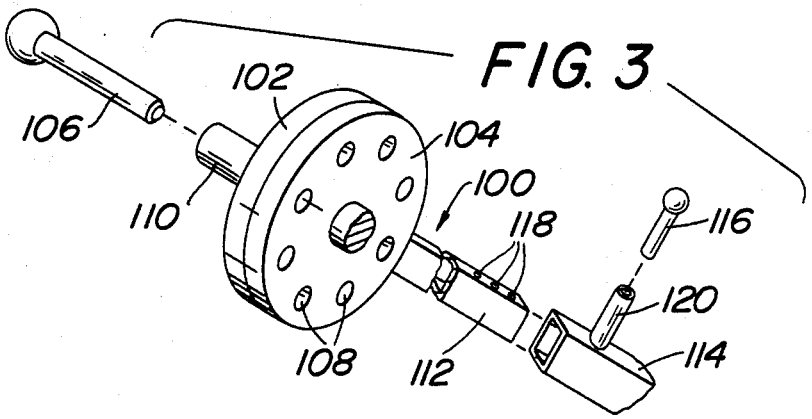
FIG. 3 is a perspective view partially in cut-away showing the actuating bar mechanism for the multi-exercise system.
Figure 6:
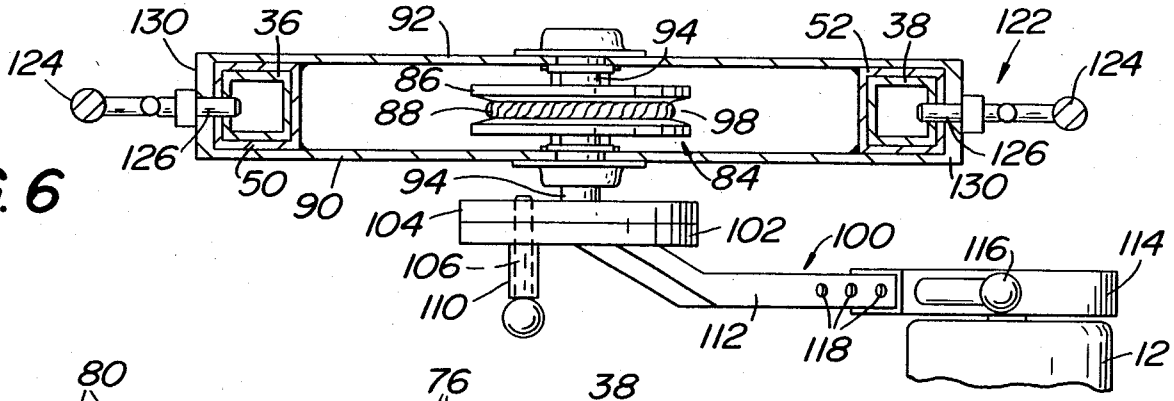
FIG. 6 is a sectional view, partially in cut-away of the rotational actuation mechanism taken along the section line 6—6 of FIG. 2.
Figure 7:
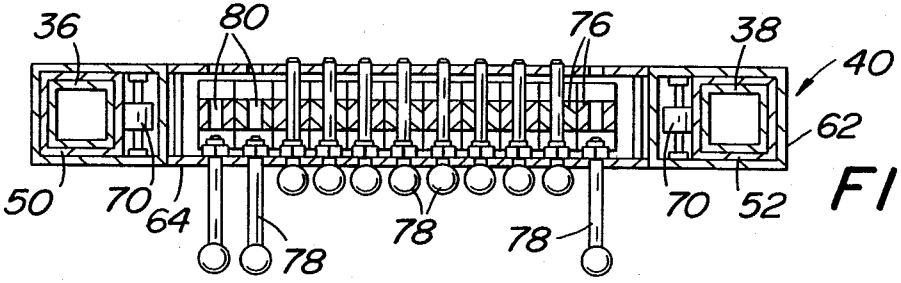
FIG. 7 is a sectional view partially in cut-away of the resistive force mechanism taken along the section line 7—7 of FIG. 2; and, FIG. 8 is a sectional view of the resistive force mechanism taken along the section line 8—8 of FIG. 2.
Figure 8:
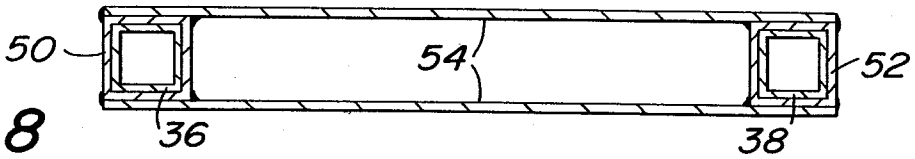

User actuated bar member 100 is rigidly secured to first disk member 102 as is shown in FIGS. 3 and 6. First disk 102 is rotatably displaceable with respect to rotatable shaft member 94. Second disk member 104 is rigidly secured to rotatable shaft member 94 and is rotatably displaceable with respect to first disk member 102.

First disk member 102 is secured to second disk member 104 by insert therethrough of disk member pin 106 through a pair of aligned disk openings 108 formed through disk members 102 and 104. As can be seen, disk openings 108 pass in a substantially 360° manner around disk members 102 and 104 and in this way, user actuated bar member 100 may be angularly positioned in an initial setting or positional location at the discretion of the user. Disk member pin 106 may pass through pin housing 110 and may be coupled thereto by a spring loading mechanism internal to pin housing 110, however, such is not important to the inventive concept as is herein described. The important consideration being that the user actuated bar member 100 may be rotated to a predetermined angular displacement at the discretion of the user prior to use of multi-exercise system 10. Once user actuated bar member 100 has been placed in a particular angular position, pin member 106 is insertable through a predetermined pair of openings 108 formed through first disk member 102 and second disk member 104. Once this coupling has been accomplished, rotation of user actuated bar member 100 due to the fact that second disk member 104 is rigidly coupled to rotatable shaft member 94, allows responsive rotation of pulley member 86 when user actuated bar 100 is similarly displaced.

User actuated bar mechanism 100 includes user bar member 112 and user tubular member 114. User tubular member 114 is slidable on user bar member 112 to allow adjustment of the length of user actuated bar mechanism 100 in its extended length dimension. User bar member 112 includes a plurality of user bar member openings 118 displaced each from the other as is clearly seen in FIGS. 3 and 6.

User pin member 116 insertable through user pin member housing 120 which is secured to user tubular member 114 is insertable through and alignable with one of the user bar member openings 118 to allow adjustment in the overall length of user actuated bar mechanism 100 at the discretion of the user.

Referring now to FIGS. 2, 4 and 6, there is further shown vertical adjustment mechanism 122 for releasably securing resistive force mechanism 40 to base frame 24 and in particular, to base bar frame members 36 and 38 at a predetermined vertical location at the discretion of the user. Vertical adjustment mechanism 122 includes handle members 124 adapted to be gripped by the user for lowering and raising resistive force mechanism 40 on base bar frame members 36 and 38. End walls 130 couple back panel and front panel 92 and 90 of upper portion 42 in rigid constrainment. Vertical adjustment pin members 126 are displaceably insertable through end walls 130 into one of a plurality of vertically displaced openings 128 formed through base bar frame members 36 and 38 as is seen in FIG. 4. In this manner, vertical adjustment pin members 126 may be removed from insertion through openings 128 and handle members 124 gripped by the user may be vertically displaced. Vertical displacement of handle members 124 allows responsive movement or displacement of resistive force mechanism upper portion 42. Resistive mechanism upper portion 42 is rigidly coupled to resistive force mechanism lower portion 44 and particular second lower portion bar member 54 through resistive force tubular members 50 and 52. Displacement of second lower portion bar member 54 causes a responsive displacement to first lower portion housing member 62 which rollingly engages tubular members 50 and 52 and rests on second lower portion housing member 56 as is seen in FIGS. 4 and 5.

When the user has reached the appropriate vertical location necessary for his or her use, vertical adjustment pin members 126 are then re-inserted through openings 128 and resistive force mechanism upper portion 42 is securely fixed to base bar frame members 36 and 38.

Referring now to FIG. 1, there is shown adjustable seating mechanism 132 included in multi-exercise system 10. Adjustable seating mechanism 132 provides for back rest member 134 and seat rest member 136 adjustable in a plurality of positional locations. Adjustable seating mechanism 132 is utilizable by a user in the event that the user is doing various seating exercises.

Adjustable seating mechanism 132 is displaceable in horizontal or transverse direction 20 with respect to base frame 24 at the discretion of the user. Adjustable seating mechanism 132 includes seating floor frame members 138 and vertically directed seating frames 140 coupled to top of bar member 142.

Both back rest 134 and seat rest 136 are coupled to top bar frame member 142 at pivot point 144 to allow rotation of seat rest 136 and back rest 134 about pivot point 144.

Arcuate back rest adjustment bar 146 includes a plurality of back rest adjustment bar openings 148 wherein one of bar openings 148 may have inserted therethrough bolts 154 for coupling arcuate back rest adjustment bar 146 to top bar frame member 142. In this manner, back rest 134 may be angularly adjusted at the discretion of the user in fixed angular position with respect to substantially horizontally directed top bar frame member 142.

Similarly, arcuate seat rest adjustment bar 150 includes a plurality of seat rest adjustment bar openings 152 through which bolts 154 may couple such to top bar frame member 142 to angularly adjust seat rest 136 at the discretion of the user.

Back rest 134 may include padded back rest 156 and rigid back rest frame 158 to which arcuate back rest adjustment bar 146 may be rigidly secured through bolting or some like mechanism. Similarly, seat rest 136 may include seat rest padded member 160 which rests upon seat rest structural member 162 to which arcuate seat rest adjustment bar 150 is fixedly secured. In this manner, both back rest 134 and seat rest 136 may be responsively inclined in an individual manner at the discretion of the user.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A multi-exercise system for providing a resistive force loading responsive to an applied force by a user comprising:

(a) a base frame having at least one substantially vertically elongated base bar frame member;

(b) resistive force means fixedly securable to said base bar frame member for transferring said user applied force to said resistive force loading, said resistive force means including an upper portion, a first lower portion and a second lower portion, said second lower portion being fixedly secured to said upper portion, and said upper and second lower portions being vertically displaceable with respect to said base bar frame member; and (c) rotational actuation means coupled to said upper portion of said resistive force means for linearly displacing said first lower portion of said resistive force means with respect to said upper portion of said resistive force means responsive to a rotational actuation force applied by said user.

2. The multi-exercise system as recited in claim 1 including a resistive force means includes:

(a) a second lower portion bar member fixedly secured to said resistive force means upper portion; and (b) a first lower portion housing member displaceably coupled to said second lower portion bar member and said upper portion of said resistive force means.

3. The multi-exercise system as recited in claim 2 including means for displaceably coupling said second lower portion bar member to said first lower portion housing member.

4. The multi-exercise system as recited in claim 3 where said means for displaceably coupling includes means for elastically coupling said second lower portion bar member to said first lower portion housing member.

5. The multi-exercise system as recited in claim 4 where said means for elastically coupling said second lower portion bar member to said first lower portion housing member includes at least one elastic cord member secured on opposing ends thereof to said first lower portion housing member and said second lower portion bar member.

6. The multi-exercise system as recited in claim 4 where said means for elastically coupling includes means for varying a resistive force loading between said first lower portion housing member and said second lower portion bar member.

7. The multi-exercise system as recited in claim 6 where said means for varying said resistive force loading includes a plurality of elastic cord members secured on one end to said second lower portion bar member and releasably secured on an opposing end to said first lower portion housing member.

8. The multi-exercise system as recited in claim 7 where means for varying said resistive force loading includes a plurality of elastic cord block members fixedly secured to said elastic cord opposing ends, said elastic cord block members being releasably coupled to said first lower portion housing member.

9. The multi-exercise system as recited in claim 8 including block pin members insertable through corresponding openings formed in said elastic cord block members and housing openings for coupling said elastic cord block members to said first lower portion housing member.

10. The multi-exercise system as recited in claim 9 including a second lower portion housing member rigidly secured to and vertically displaced from said second lower portion bar member.

11. The multi-exercise system as recited in claim 10 where said elastic cord block members are positionally located contiguous said second lower portion housing member when said elastic cord block members are released from said first lower portion housing member.

12. The multi-exercise system as recited in claim 1 including means for releasably securing said resistive force means to said base frame at a predetermined vertical location.

13. The multi-exercise system as recited in claim 12 where said releasable securement means includes an upper portion frame member releasably securable to said base bar frame member.

14. The multi-exercise system as recited in claim 13 where said releasable securement means includes at least one upper portion pin member secured to said upper portion frame member and insertable into vertically displaced openings formed in said base bar frame member for fixedly securing said upper portion frame member to said base bar frame at a predetermined vertical location.

15. The multi-exercise system as recited in claim 1 where said rotational actuation means is rotationally displaceable about a singular axis.

16. The multi-exercise system as recited in claim 15 where said rotational actuation means is secured to a displaceable first lower portion housing member for vertically displacing said lower portion housing member responsive to a rotational displacement of said rotational actuation means.

17. The multi-exercise system as recited in claim 16 where said rotational actuation means includes a pulley member rotationally secured to an upper portion frame member for rotation about said singular axis.

18. The multi-exercise system as recited in claim 17 including a pulley cord member secured on opposing ends thereof to said lower portion housing member and said pulley member respectively.

19. The multi-exercise system as recited in claim 1 including user actuated bar means releasably secured to said rotational actuation means for rotatably displacing said rotational actuation means responsive to said applied force by said user.

20. The multi-exercise system as recited in claim 19 including means for rotationally adjusting said user actuated bar means in rotational registration with said rotational actuation means.

* * * * *